US006705491B1

(12) United States Patent
Lizerbram et al.

(10) Patent No.: US 6,705,491 B1
(45) Date of Patent: Mar. 16, 2004

(54) SELF CONTAINED ADDITIVE RESERVOIRS FOR USE WITH BEVERAGE CONTAINERS

(76) Inventors: Eric K. Lizerbram, 3586 Camino Arena, Carlsbad, CA (US) 92009; Todd G. Buchholz, 214 Gibson Point, Solana Beach, CA (US) 92075; William S. Anapoell, 12383 Caminito Granate, San Diego, CA (US) 92130

( * ) Notice: Subject to any disclaimer, the term of this patent is extended or adjusted under 35 U.S.C. 154(b) by 0 days.

(21) Appl. No.: 10/357,401

(22) Filed: Feb. 4, 2003

Related U.S. Application Data

(63) Continuation-in-part of application No. 10/241,452, filed on Sep. 12, 2002.

(51) Int. Cl.[7] ..... B67D 5/60

(52) U.S. Cl. ..... 222/145.1; 222/154; 222/548; 206/221

(58) Field of Search ..... 222/145.1, 154, 222/548; 206/221

(56) References Cited

U.S. PATENT DOCUMENTS

| | | | |
|---|---|---|---|
| 1,254,115 | A | 1/1918 | Brand |
| 2,631,521 | A | 3/1953 | Atkins, Jr. |
| 2,813,649 | A | 11/1957 | Lipari |
| 2,867,536 | A | 1/1959 | Mead et al. |
| 3,305,368 | A | 2/1967 | Bourelle |
| 3,321,097 | A | 5/1967 | Solowey |
| 3,521,745 | A | 7/1970 | Schwartzman |
| 3,655,096 | A | 4/1972 | Easter |
| 3,717,476 | A | 2/1973 | Harvey |
| 3,743,520 | A | 7/1973 | Croner |
| 3,779,372 | A | 12/1973 | DeLloret |
| 3,802,604 | A | 4/1974 | Morane et al. |
| 3,968,872 | A | 7/1976 | Cavazza |
| RE29,725 | E | 8/1978 | Johnson et al. |
| 4,149,633 | A | 4/1979 | Nilson |
| 4,264,007 | A | 4/1981 | Hunt |
| 4,408,690 | A | 10/1983 | Ferrero |
| 4,473,530 | A | 9/1984 | Villa-Real |
| 4,557,377 | A | 12/1985 | Maloney |
| 4,717,016 | A | 1/1988 | Dalgleish |
| 4,727,985 | A | 3/1988 | McNeirney et al. |
| 4,765,512 | A | 8/1988 | Bull, Jr. |
| 4,779,722 | A | 10/1988 | Hall |
| 4,836,370 | A | 6/1989 | Bosshard |
| 4,844,917 | A | 7/1989 | DeLorimiere |

(List continued on next page.)

*Primary Examiner*—Philippe Derakshani
(74) *Attorney, Agent, or Firm*—Millen, White, Zelano & Branigan, P.C.

(57) ABSTRACT

A closure element for a beverage container is in the form of a sports cap, other closer, or initially closed straw, and provides a chamber for containing colorants in the form of liquids, gels, granules, powders, tablets or other solid bodies. Closures such as valves, rupturable membranes, hinged doors, clamps or undersized holes provide closer structure for initially keeping the chambers closed with respect to the colorant so that colorant does not flow into the beverage until released to do so by the customer. Upon opening ends of the chambers, colorants flow into beverages in the containers, which containers are made of see-through/clear or partially see-through materials. In a preferred embodiment, the colorant is a material enclosed in at least one capsule which flows through openings in the chamber within the closure element when the capsule is ruptured or perforated. Coloration of the beverage is voluntarily initiated by the consumer, and the thus colored beverages are then consumed by passage through the closure element. In one embodiment of the invention, the colorant is a medicinal agent which can be colored or may be clear. The medicinal agent is released into liquid, which may be water, for ingestion by a patient.

14 Claims, 14 Drawing Sheets

U.S. PATENT DOCUMENTS 5,217,433 A 6/1993 Bunin
5,246,142 A 9/1993 Di Palma et al.
5,310,564 A 5/1994 Kimm
5,373,937 A 12/1994 Lamboy
5,384,139 A 1/1995 Vasseneix
5,431,276 A 7/1995 Lialin
5,474,209 A 12/1995 Vallet Mas et al.
5,529,179 A 6/1996 Hanson
5,772,017 A 6/1998 Kang
5,836,479 A 11/1998 Klima et al.
5,875,888 A 3/1999 Albisetti
5,875,889 A 3/1999 Albisetti
5,884,759 A 3/1999 Gueret
5,885,635 A 3/1999 Spring et al.
5,909,753 A 6/1999 Rossi et al.
5,927,549 A 7/1999 Wood
5,944,175 A 8/1999 Albisetti
5,971,140 A 10/1999 Frutin
5,979,657 A 11/1999 Bumbera
6,003,728 A 12/1999 Elliott
6,036,004 A 3/2000 Bowen
6,073,808 A 6/2000 Klima et al.
6,092,648 A 7/2000 Sellars
6,098,795 A 8/2000 Mollstam et al.
6,105,760 A 8/2000 Mollstam et al.
6,113,257 A 9/2000 Sharon et al.
6,138,821 A 10/2000 Hsu
6,148,996 A 11/2000 Morini
6,152,296 A 11/2000 Shih
6,164,495 A 12/2000 Manesis
6,165,523 A 12/2000 Story
6,182,822 B1 2/2001 Albisetti
6,182,865 B1 2/2001 Bunschoten et al.
6,209,718 B1 4/2001 Mollstam et al.
6,224,922 B1 5/2001 Fonte
6,230,884 B1 5/2001 Coory
6,257,428 B1 7/2001 Caola
6,293,394 B1 9/2001 Marbler et al.
6,293,433 B1 9/2001 Jouolia
6,305,576 B1 10/2001 Leoncavallo
6,372,270 B1 4/2002 Denny

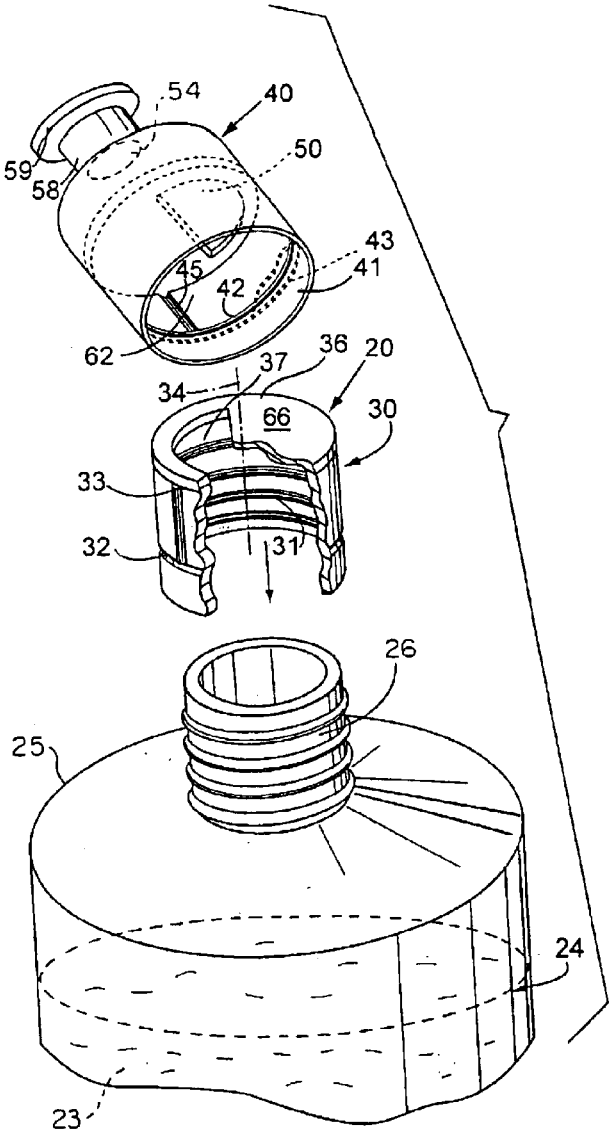
Fig. 1
Fig. 4A
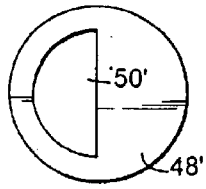
Fig. 4C
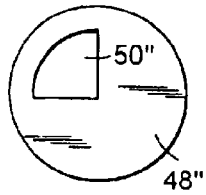
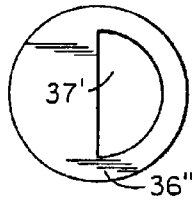
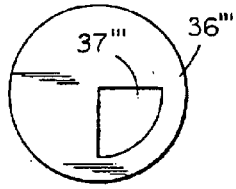
Fig. 4B
Fig. 4D
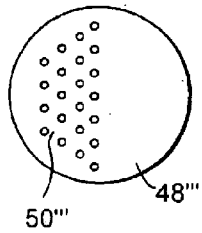
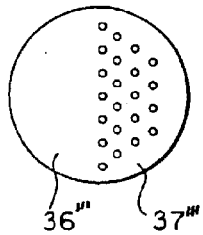
Fig. 4E
Fig. 4F
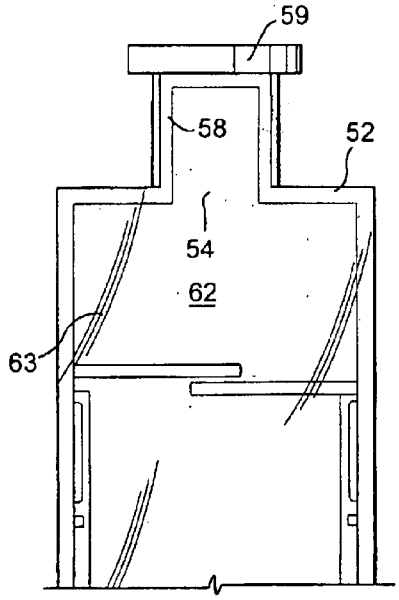
Fig. 3

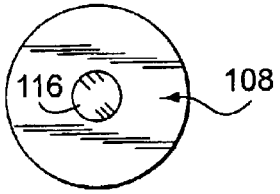
Fig. 11
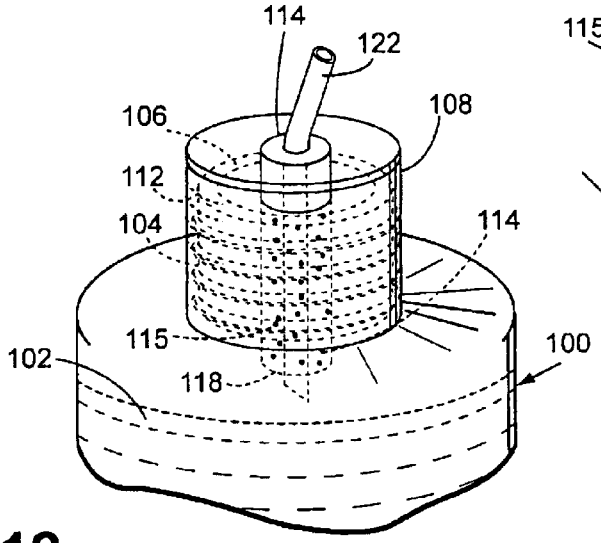
Fig. 8
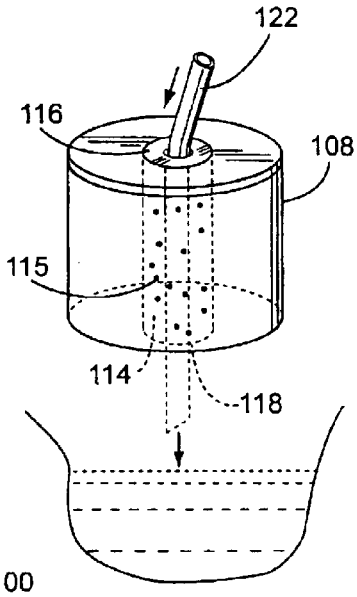
Fig. 9
Fig. 12
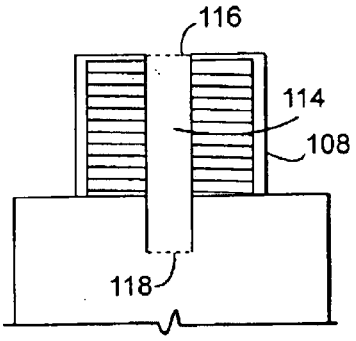
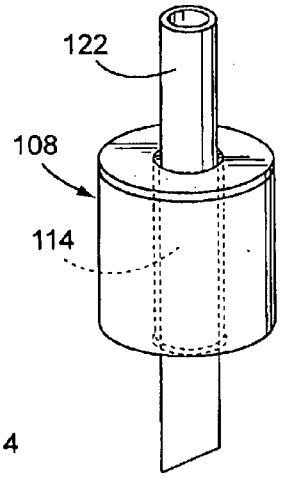
Fig. 10
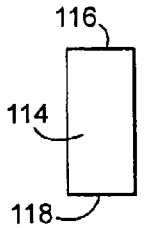
Fig.13A
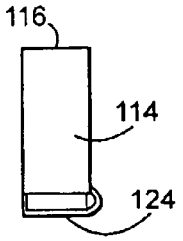
Fig. 13B Fig. 14
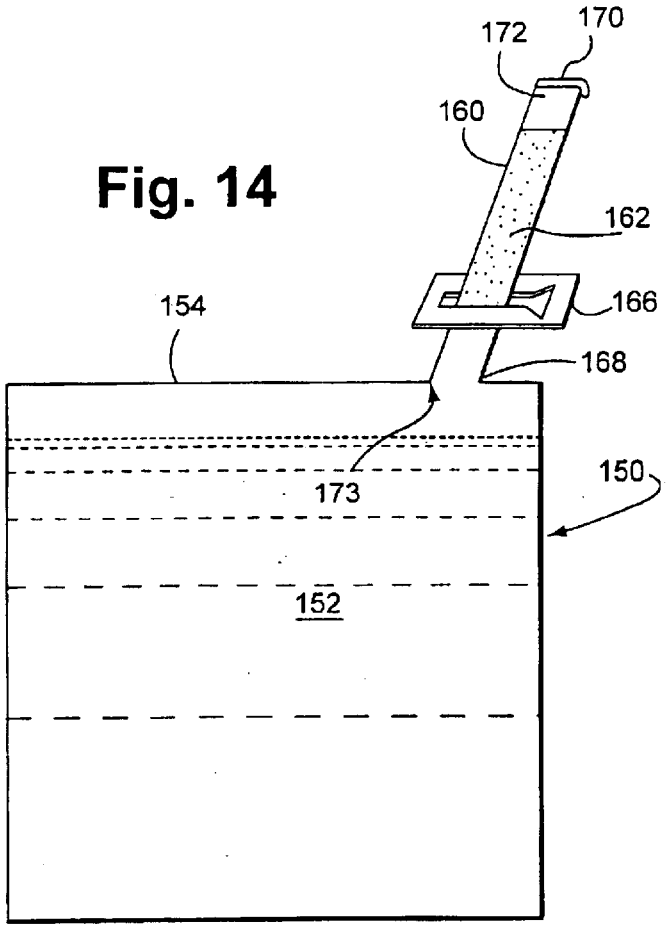
Fig. 18
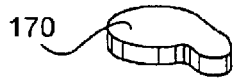
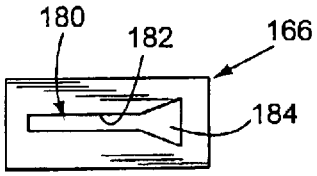
Fig. 15
Fig. 16
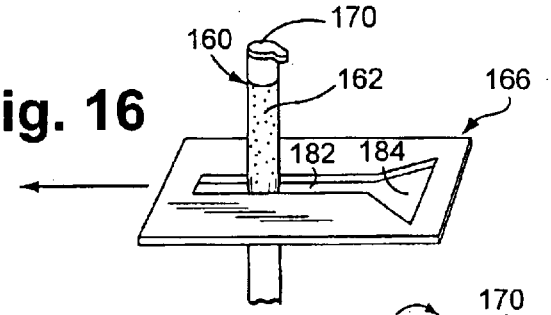
Fig. 17
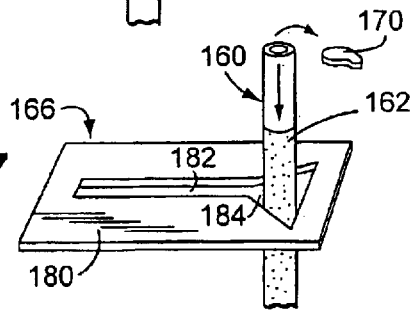

SELF CONTAINED ADDITIVE RESERVOIRS FOR USE WITH BEVERAGE CONTAINERS

RELATED APPLICATION

This application is a Continuation-In-Part of U.S. application Ser. No. 10/241,452 filed Sep. 12, 2002.

FIELD OF THE INVENTION

The present invention is directed to self-contained additive reservoirs for use with beverage containers, and more particularly the present invention is directed to additive reservoirs wherein the additives are colorants that are disposed in passageways through which beverages in the container are withdrawn for consumption.

BACKGROUND OF THE INVENTION

In order to enhance the experience of drinking a beverage, additives are added to beverages for many purposes. For example, sugar, sweeteners and/or cream is added to coffee or tea. Flavorings of various sorts are also added to other beverages. Color is a readily apparent characteristic of any beverage and food coloring is frequently added to beverages in order to make them more appealing. Many beverages are clear and would be more marketable if they could be of various colors.

Visual stimulation increases the interest in using and consuming food items, but to date that visual stimulation has not been at the discretion of the consumer in a convenient configuration. There are arrangements for providing color additives to beverages, but these arrangements require the consumer to remove a top or cap. None of the arrangements incorporate in a sports-cap, a self contained colorant reservoir or a colorant cylinder inside of a cap, nor do any arrangements employ a colorant straw with a pouch to provide visual stimulation in a contained beverage. Moreover, mixing techniques currently available are very complicated to use, too costly to produce and employ complicated structures. Consequently, no present marketing item efficiently and cost-effectively allows a coloring agent to be mixed with a clear or neutral beverage for visual entertainment while consuming the beverage.

SUMMARY OF THE INVENTION

The present invention is directed to a self contained additive reservoir which is configured for attachment to a beverage container for adding to a beverage in the container, additives such as, but not limited to, coloring agents. Agents could also include vitamins, minerals or other consumable agents that in some respect enhance the beverage consumed.

In accordance with the principles of the present invention, a color additive is introduced to a beverage by a customer from a closure element is which is also used as a conduit to consume the beverage.

The closure element is configured for attachment to a dispensing opening of the beverage container, the closure element comprising a coupling for attaching the closure element to the dispensing opening of the beverage container.

In the first embodiment, a chamber is positioned within the closure element, the chamber containing a colorant agent and having a first end and a second end. The first end is in communication though the dispensing opening of the beverage container with a beverage within the container, and the second end is configured to dispense the beverage as the beverage passes through the chamber. A first closer is provided for closing the first end of the closure element; and a second closer is provided for closing the second end of the closure element. An opener opens at least the first closer to let the colorant flow therethrough into the beverage, and means is provided for allowing opening of the second closer to dispense the beverage, mixed with the colorant, therethrough to the consumer.

According to a first embodiment of the invention, the closure element is a screw cap having threads which provide a coupling to the dispensing opening of the beverage container. Also according to the first embodiment of the invention, the screw threads are on a first cylindrical member and thread onto the dispensing opening of the beverage container. A chamber initially containing the colorant is in a second cylindrical member mounted on the first cylindrical member. The first closer is comprised of a wall on the first cylindrical member which faces a floor on the second cylindrical member, with both the wall and floor having initially unaligned openings therethrough. The opener is a rotatable connection disposed between the first and second cylindrical members which allows a customer to twist the second cylindrical member with respect to the first cylindrical member to align an opening in the floor of the colorant agent chamber with the opening through the wall of the first cylindrical member. This allows the colorant to flow into the beverage; and with the colorant therein, to flow to the second closer. The second closer is preferably a sports cap valve mounted on the closure element to provide a means for allowing opening of the second closer.

In a further aspect of the invention, the closure element has at least one detent on either the first or second cylindrical member which engages an indentation in the other cylindrical member to temporarily hold the members in a fixed position with respect to one another, until the second cylindrical member is rotated with respect to the first cylindrical member.

In still a further aspect of the invention the closure element, the colorant in the closure element is in the form of a liquid, a gel, granules, powder or a solid body such as a tablet.

In an additional aspect of the invention the colorant chamber is divided into a plurality of compartments wherein the compartments each contain a different colorant.

In another embodiment of the invention, the closure element has a colorant chamber disposed within the screw cap, wherein a first closer seals a bottom end of the chamber adjacent to the beverage within the beverage container, and a second closer seals an outlet end of the chamber, through which outlet end the beverage is consumed. A tube (or drinking straw) is provided for cooperating with the closure, wherein upon inserting the tube through the outlet end of the chamber, the second seal is opened, and upon continuing insertion of the tube through the bottom end of the chamber, the first seal is opened thus allowing colorant in the chamber to flow into the beverage. Upon the tube being immersed therein, the beverage is consumable through the tube.

In a third aspect of the aforementioned embodiment, the tube or drinking straw is coupled to a dispensing opening of a clear beverage pouch by a unitary or integral joint. The tube or drinking straw contains a colorant or colorants, and is sealed above by a closer seal and below by a clamp. The beverage pouch and colorant drinking straw or tube are unitary, and when the first closer in the form of a clamp disposed between the dispensing opening of the pouch and the free end of the tube is intentionally moved to an open position, the colorant in the drinking straw mixes with the beverage in the clear pouch. The second closer is a removable seal at the free end of the tube.

In still another aspect of the invention the colorant is contained within a capsule which when opened, ruptured, punctured, squeezed or otherwise disturbed, releases the colorant into the beverage.

With respect to the concept of the colorant being retained in a capsule, a closure element is provided for attachment to a dispensing opening of a beverage container. The closure element comprises a coupling for attaching the closure element to the dispensing opening of the beverage container and a chamber within the closure element. The chamber contains a colorant agent within a capsule and has a first portion and a second portion. The first portion in communication with a beverage through the dispensing opening of the beverage container and the second portion is configured to dispense the beverage therethrough as the beverage passes through the chamber. A first closer is provided for closing the first portion of the closure element so that the capsule does not fall into the beverage and a second closer for closing the second portion of the closure element. A first opener for opening the capsule to let the colorant flow therefrom through the first closure into the beverage and a second opener for allowing opening the second closer for dispensing the beverage mixed with the colorant therethrough to the consumer.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 is a an exploded perspective view, partially in section, of a first embodiment of the present invention showing a sports cap with its components not aligned;

FIG. 3 is a side elevation of the sports cap of FIGS. 1 and 2;

FIGS. 4A and 4B are top views of a first embodiment of operating valve portions of the cap;

FIGS. 4C and 4D are top views of a second embodiment of operating valve portions of the cap;

FIGS. 4E and 4F are top views of a third embodiment of valve portions of the cap, the valve portion being configured as capillaries;

FIG. 8 is a perspective side view showing a third embodiment of the invention, with portions in phantom, wherein a straw is utilized to initiate deposit of a color additive to a beverage;

FIG. 9 has a view showing a colorant containing chamber used in FIG. 8;

FIG. 10 is a side view showing a portion of a straw extending through the colorant chamber wherein the straw has a diameter slightly smaller than that of the chamber;

FIG. 11 is a top view of the beverage container cap of FIGS. 8–10;

FIG. 12 is side elevation of the cap and beverage container;

FIG. 13A is a side view of a first embodiment of the colorant chamber using two foil membranes as seals;

FIG. 13B is a side view of a second embodiment of the colorant chamber using a foil membrane at its top end and hinged valve at its bottom end;

FIG. 14 is a side view of a fourth embodiment of the invention in which a straw contains a colorant agent;

FIG. 15 is a top view of a slidable valve element used with the straw of FIG. 14;

FIG. 16 is a perspective view of the slidable valve element of FIG. 15 shown holding the straw closed with the colorant agent therein;

FIG. 17 is a side view similar to FIG. 16 but with the slideable valve element positioned to let the colorant agent flow into the beverage, and FIG. 18 is a perspective view of a closer used with the straw of FIGS. 14, 16 and 17.

DETAILED DESCRIPTION

Figure 2:
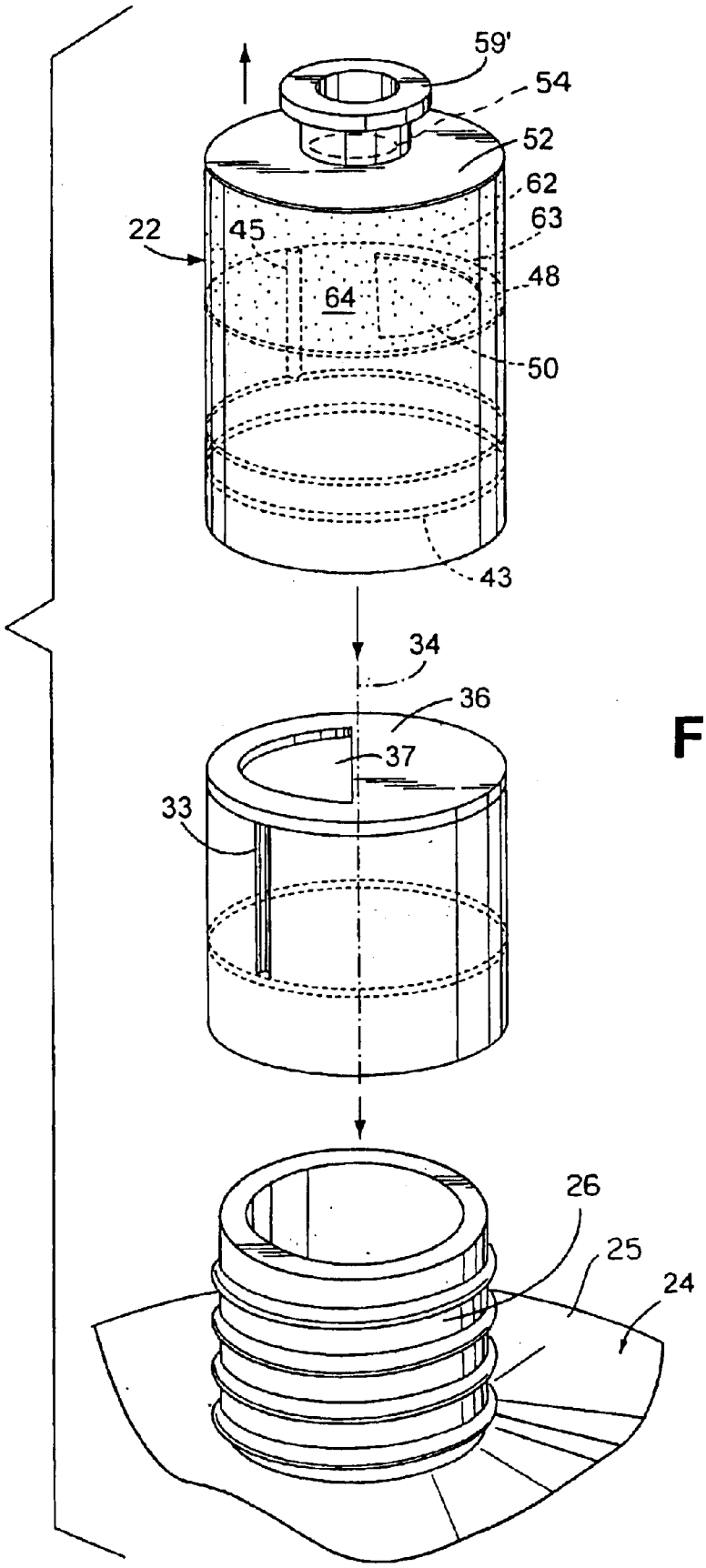
FIG. 2 is a side perspective view, with portions in phantom, showing components of sports cap of FIG. 1 aligned with the top of a beverage container.
Figure 5:
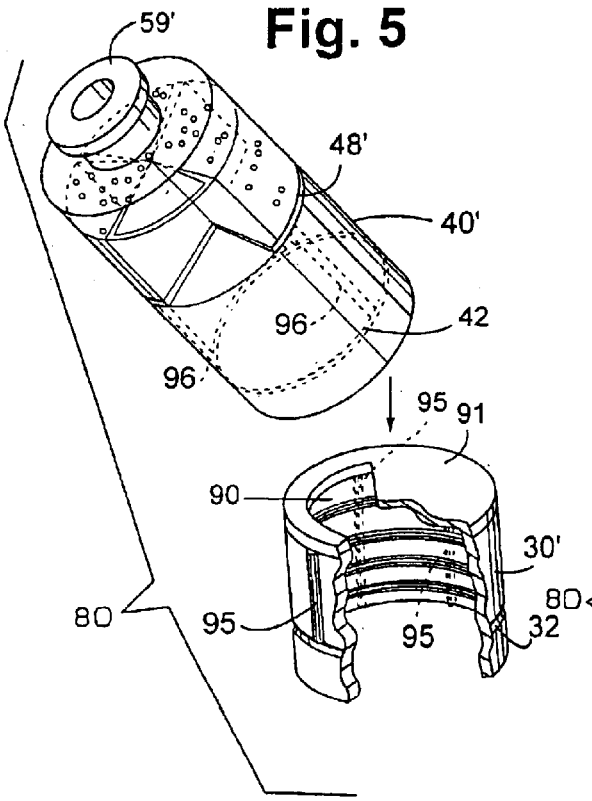
FIG. 5 is an exploded perspective view, partially in section, showing second embodiment of a sports cap which contains multiple colorant agents.
Figure 6:
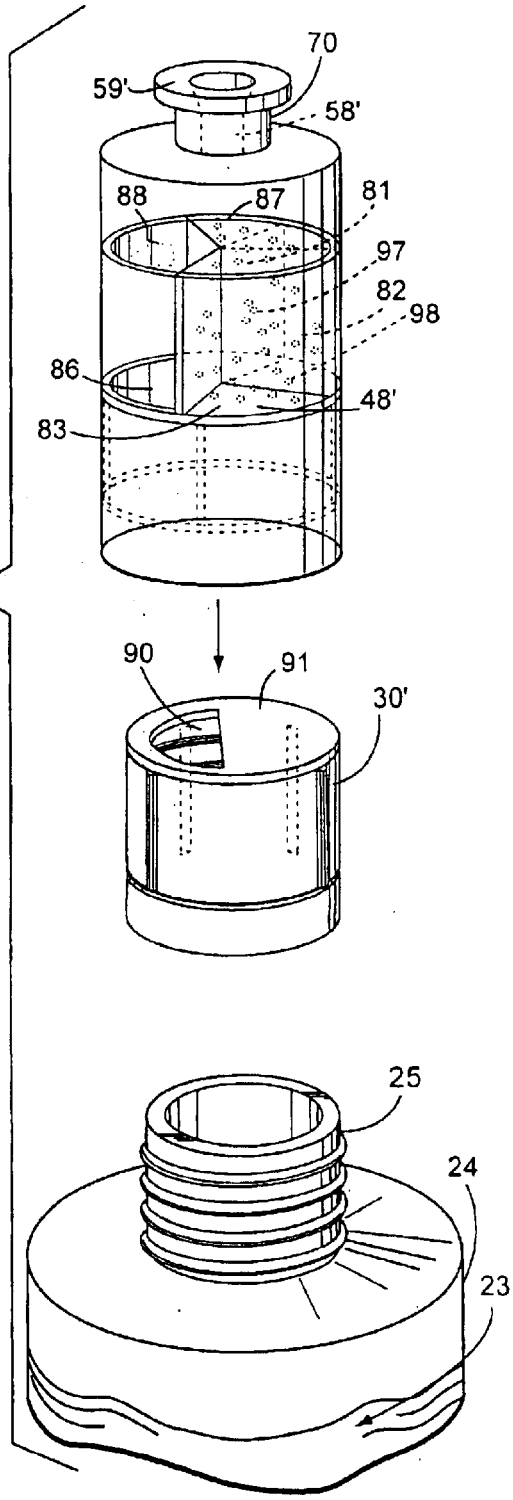
FIG. 6 is a side exploded view, with portions in phantom, showing components of FIG. 5 in alignment with a sports bottle for assembly thereon.

Referring now to FIGS. 1, 4A–F, there is shown a first embodiment 20 of a closure element 20 configured in accordance with the present invention as a sports cap, wherein a single colorant agent is contained within and dispensed from a colorant containing assembly 22 into a clear or colored beverage 23 in a beverage container 24. The closure element 20 is attached to the beverage container 24, which beverage container is preferably of a pre-existing design and configuration and includes beverage containing portion 25 and an externally threaded neck 26 on which the closure element 20 is mounted. Manipulation of the colorant container 22 by a consumer releases colorant into the beverage 23 packaged by the beverage container 24. In other words, a consumer initiates coloration of the beverage 23, rather than the packager of the beverage 23 coloring the beverage during manufacture and prior to sale.

The colorant dispenser 22 has a first portion configured as a first cylindrical member 30 with internal threads 31 that thread onto the externally threaded neck 26 of the beverage container 24. The first cylindrical member 30 has an exterior groove 32 and one or more longitudinally extending exterior ribs 33. Extending radially with respect to the axis 34 of the first cylindrical member 30 is a top wall 36 having an apertured area or opening 37 which may be one or more holes through the wall 36, which holes may also be capillaries.

Integral with the first cylindrical member 30 is a second cylindrical member 40 which forms a second portion of the closure element 20. The second cylindrical member 40 has adjacent its bottom edge 41 a circular internal rib 42 which is received in the exterior groove 32 of the first cylindrical member 30 so as to rotatably mount the second cylindrical member 40 on the first cylindrical member 30. The circular rib 42 can also be in the form of a gasket in order to seal the second member 40 with respect to the first member 30. Alternatively, a separate gasket 43 may be provided to accomplish or enhance sealing. The second cylinder member 40 has longitudinally extending groove 45 which receives the longitudinally extending rib 33 on the first member 30 to hold the second cylindrical member 40 in specific rotational position relative to the first cylindrical member. Disposed above the longitudinal groove 45 is a floor 48 which has an opening 50 therethrough. Opening 50 may be a single opening, a plurality of openings or an array of perforations or capillaries and forms a first opening through the first portion of the closure element 20.

Above the floor 48, there is a top wall 52 which forms the top surface of the cap forming the sports cap 20, the top wall 52 having an opening 54 therethrough which is in communication with a neck 58 the opening 50 forming a second opening through the second portion of the closure element 20. The neck 58 cooperates with a conventional sports cap spout 59, such as the spout of a sports bottle which allows the consumer to drink directly from the beverage container 24.

The opening 37 through the first cylindrical member 30 is an opening through a first portion of the closure element 20 while the opening 54 through the second cylindrical member 40 is an opening through a second portion of the closure element 20.

In accordance with the principles of the present invention, the space 62 between the floor 48 and top wall 52 of the second cylindrical member 40 contains a coloring agent 63 which may in the form of a liquid, the liquid being either free flowing or initially a gel, or in solid form such as granules, a powder a mixture of powders, or even in the form relatively large bodies such as tablets. In other words, the colorant 63 can be in any form which suspends or dissolves to a greater or lesser extent in the beverage 23 retained within the beverage container 24. The colorant 63 is retained within the space 62 by misalignment of the openings 50 and 37 in the cylindrical members 40 and 30, respectively. As long as the opening 37 in the first cylinder member 30 is covered by the closed portion 64 of the floor 48 of the second cylindrical member 40, and the aperture 50 of the second cylindrical member 40 is closed by the closed portion 66 of the top wall 36 of the first cylindrical member 30, the colorant 63 is held within the space 62.

In order to dispense the colorant 63 from the space 62 to the beverage 23, the second member 40 is rotated so that the opening 50 aligns with the opening 37 which allows the colorant 63 to drain from the space 62, through the cylindrical member 30 and into the beverage container 24 containing the beverage 23. When the beverage is consumed, the beverage flows through the first opening 37 in cylindrical member 30, into the space 62 in the second cylindrical member 40 and through the spout 59 of the sports cap 20.

Referring now to FIGS. 4A–4F, it is seen that the openings 37 in the first cylindrical member 30 and 50 in the second cylindrical member 40 may have a number of configurations, such as but not limited to: the semicircular valve configurations 37' and 50' of FIGS. 4A and 4B; the pie shaped apertures 50" and 37" of FIGS. 4C and 4D, and the capillaries 50'" and 37'" of FIGS. 4E and 4F. When the perforations 50 align with the perforations 37, the colorant in chamber 62 flows through the floor 48 and top wall 36 into the beverage container 24.

Referring now to FIGS. 5–7D, there is shown a second configuration of the first embodiment of the invention wherein the closure element in the form of a sports cap 80 has a plurality of colorant additive compartments 81, 82 and 83 instead of the single compartment 62 of the first embodiment of FIGS. 1–4. With the sports cap 80, the second cylindrical 40' member has a floor 48' with a single opening 86 therethrough and a ceiling 87 with a single opening 88 therethrough which is aligned with the opening 86 in the floor 48' of the second cylindrical member 40'. When the openings 88 and 86 are aligned, the beverage 23 in the container 24 can flow through both the first cylindrical member 30' and the second cylindrical member 40' for consumption by the customer.

In order to color the beverage 23, the second member 40' is rotated about its axis to align one of the compartments 81, 82 or 83 with the opening 90 in the top wall 91 of the first member 30'. As with the arrangement of FIGS. 1–4, a rib-in-slot slot latching arrangement is used to position the second cylindrical member 40' with respect to the first cylindrical member 30', only there are three or four ribs and cooperating slots on the cylindrical members instead of one or two ribs or slots on each member. For example, if there are three colorants to be dispensed, then there are three or four ribs 95 in the first cylindrical member 30' and three or four grooves 96 in the second cylindrical member 40'; positioned for example at 90°, 180° and 270°.

If there are only two colorants, then there are two or three ribs 95 in the first cylindrical member 30' and two or three grooves 96 in the second cylindrical member 40'. In each case, the ribs 95 and the grooves 96 are preferably disposed at 90° intervals, although other angular intervals, may be employed.

Figure 7A:
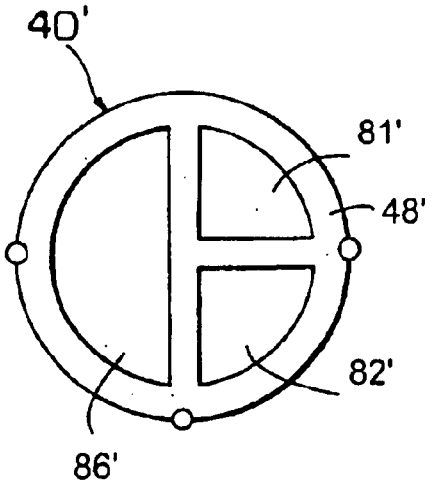
FIGS. 7A and 7B are top views of a valve arrangement for two coloring agents used with the arrangements of FIGS. 5 and 6.
Figure 7C:
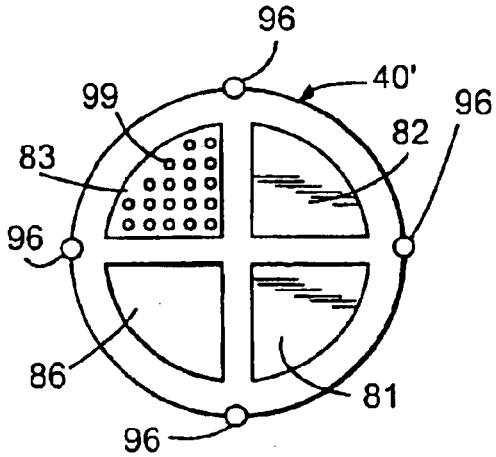
FIGS. 7C and 7D are top views of a valve arrangement for three coloring agents used with the sports cap of FIGS. 5 and 6.
Figure 7B:
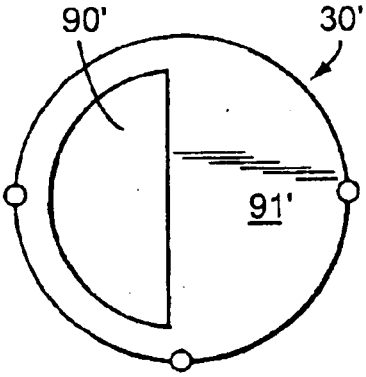

Referring now to FIGS. 7A and 7B, it is seen that the opening 90' through the wall 91 of the first cylindrical member 30' is almost semicircular in order to align with one of the colorant compartments 81 and 82, with respective openings 81' and 82', or possibly with both colorant compartments 81 and 82, so that two colorants can be dispensed simultaneously. After the colorants have been dispensed from the compartments 81 and 82 into the beverage 23 in the container 24, the opening 88 that is aligned with the opening 86 is then aligned with the opening 90' so that the opening 88 is also aligned with the opening 90'. The beverage 23 which has been colored by colorants 97 or 98 in compartments 81 or 82 (or in both compartments) is then available for drinking through the spout 70.

Figure 7D:
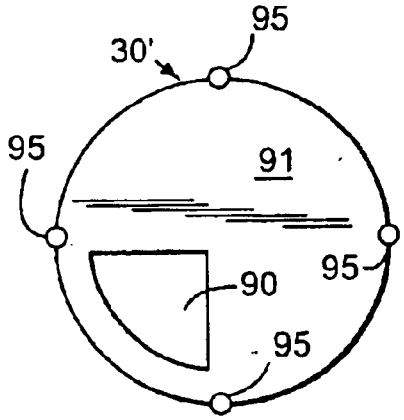

Referring now to FIGS. 7C and 7D, it is seen that the opening 90 in the top wall 91 of the first cylindrical member 30' is a cord portion of one quarter of a circle. When either of the three colorant containing compartments 81, 82 or 83 is aligned with the opening 90, the respective colorant flows through the opening 90 into the beverage 23 in the beverage container 24. If desired, colors can be mixed by sequentially aligning the colorant chambers 81, 82 and 83 in the second cylindrical member 40' with the opening 90 in the first cylindrical member 30'. The colorant in the chamber 83 may be released through very small openings such as capillaries 99 so as to have a particular pattern of dispersal in the beverage 23. When the customer desires to consume the beverage, the opening 86 is then aligned with the opening 90 which automatically aligns the opening 88 with the opening 90, since the opening 88 is aligned with the opening 86. The beverage 23 is then consumed through the spout 59' of the sports cap 80.

FIGS. 8–13B: Threaded Cap with Central Colorant Cylinder

Referring now to FIG. 8 there is shown a second embodiment of the invention wherein a sports bottle 100, or other container containing a beverage 102, has a neck 104 with a mouth 106 which is closed by a closure element in the form of a screw cap 108 which is threaded onto the neck 104 of the bottle 100 by threads 112. The threaded cap 108 has a container 114 therein which contains a colorant material 115, such as a colorant liquid, gel or a solid in the form of powders, granules or even a tablet or tablets. Colorant container 114 has an upper membrane 116 and a lower membrane 118. Preferably, the upper membrane 116 and lower membrane 118 are made of foil which can be penetrated sequentially by a relatively stiff tube, such as a straw 122. When the straw 122 is pushed through the lower membrane 118, the colorant 115 within the chamber 114 is released and flows into the beverage 102. Instead of having a lower foil 118 as is seen in FIG. 13A, a hinged plastic floor 124 may be used, which hinged floor is pivoted away from the bottom of the chamber 114 by the straw 122. The lower membrane 118 or hinge 124 form a first closer while the upper membrane 116 forms a second closer.

The axial length of the chamber 114 may be equal to, greater than or shorter than the axial length of the screw cap 108. The straw 122 may have a diameter which is substantially smaller than the diameter of the chamber 114, or as is seen in FIG. 10, may be only marginally smaller so that it has clearance to slide through the container 114 to open the first closer by either rupturing the foil 118, or pushing the hinged plastic floor 124 open. The tinted beverage is then drawn through the closure element in the form of the screw cap 108 by virtue of being pulled or sucked through the straw 122.

FIGS. 14–18—Pouch with Colorant Straw

Referring pow to FIG. 14 there is shown a pouch 150 containing a beverage 152, the pouch 150 having a top portion 154 with which a closure element in the form of a straw 160 is integral. The pouch 150 is relatively flexible, whereas the straw 160 is relatively stiff and contains a colorant 162. In order to keep the colorant 162 within the straw 160, a clamp 166 forms a first closer which closes the straw 160 adjacent its bottom end 168 and a cap 170 forms a second closer which closes the mouth 172 of the straw. The cap 170 is preferably in the form of a removable foil but may be another sealing structure.

The coupling 173 of the straw 160 with the cap 170 may be unitary, with the straw formed simultaneously with the pouch, or may be integral with the straw attached to the pouch after one or the other is formed.

In accordance with a preferred embodiment of the clamp 166, the clamp 166 has a slot 180 therein a relatively narrow, longitudinally extending portion 182 which is sufficiently narrow to squeeze the straw 160 shut and seal the colorant 162 within the straw. Narrow portion 182 expands into a relatively wide portion 184 which has a diameter greater than the diameter of the straw 160 and allows the straw to expand outwardly so that the colorant 162 drains into the beverage 152 within the pouch 150. Preferably, the pouch 150 is transparent so that the consumer sees the colorant 162 flow into the beverage 152.

If the colorant 162 is a liquid, the cap 170 (preferably in the form of aluminum foil or another seal) is opened to remove any vacuum which might retain the colorant within the straw 160, the straw thereafter providing a drinking straw for the consumer after the colorant 162 has flowed down into the beverage 152. While the colorant 162 is preferably in a liquid form, it can also be in the form of a powder, granules, capsule or a gel so as to have various effects upon passing into and through the beverage 152.

In accordance another embodiment of the invention described herein, and especially in accordance with the pouch configurations of FIGS. 14–18, the pouch 150 is transparent or translucent and the beverage may optionally be water or another consumable liquid suitable for dissolving or suspending a medical agent 162 which is dispensed from the straw 160. In this embodiment of the invention, the medical agent 162 may be clear or colored since the primary purpose is to medicate a patient. Such an arrangement is especially useful for patients who have difficulty in swallowing pills or capsules. While the pouch 150 of FIGS. 14–17 is a preferred arrangement for such a device, the concept is applicable to other structures such as the bottle-type containers 24 and 100 and their associated closure elements 20, 20' and 108, respectively.

FIGS. 19–28: Colorant Contained Within Capsule

In a fifth embodiment of the invention shown in FIGS. 19–28, the closure element 195 is configured preferably of three members and is threadably mounted onto a beverage container. The first member 200 is a screw cap screwed directly on the neck of a beverage container and modified to hold a colorant capsule 201, wherein the colorant capsule 201 contains a consumable color agent, vitamin, mineral, flavor, or any variation thereof; the capsule 201 being held within a first portion which is a chamber defined by a channel 202 having first holes 203 and a sharp ridge 204 on the floor of the channel 202 to rupture the capsule 201 by puncturing the capsule. The colorant capsule 201 is alternatively oval, round, donut shaped, or any other variation, shaped to fit within the channel 202 of the first member. The first member 200 has second portion configured as a perforated hub 205 in the form of a central elevated portion with second holes 206 therein to allow flow-through for consumption of the beverage once the beverage is colored.

The dimensions of the capsule or capsules 201 are greater than the dimensions of the first holes 203. Consequently, the capsule or capsules 201 and thus the colorant therein can not pass through the first holes 203 until the capsule is compromised in some way by being opened through squeezing, rupturing, puncturing, or other wise being caused to release the colorant. Accordingly, the first member 200 has a first portion which is closed with respect to the colorant agent enclosed in the capsule(s), the closing structure being accomplished by selecting a size for the capsule(s) which is larger than the size of the first holes 203. When the structural integrity of the capsule(s) 201 is compromised to release the colorant, the capsule opens and the colorant passes through the first holes 203 into the beverage within the container.

Likewise, the second portion of the first member 200 is closed by the second holes 206 which also have a smaller size than the capsule(s) 201. Passage of the beverage colored by the colorant through the second holes 206 for consumption by the customer remains blocked until the sports cap 210 is opened.

A second member (207) is configured as an outer shell portion of the closure element 195. The second member 207 slides axially upon the first member (200) toward the capsule 201 in the channel 202. The second member (207) has a roof (208) which seals the colorant capsule (201) inside the channel (202) of the first member (200) when the second member (207) in it's initial position. The second member (207) may or may not have a sharp, jagged circumferential ridge (204) on its' roof for purposes of puncturing the colorant capsule (201). The second member has a spout (209) containing third holes (209*a*), which acts as a flow-through channel for the beverage being consumed.

A third member (210) is a sliding sports cap closure element, which slidably fits onto the spout (209) of the second member (207).

Colorant contained within the capsule (201) is released when the capsule is punctured and is dispensed into the clear beverage within a see through, clear drinking bottle (211) when the second member (207) is pushed downward upon the first member (200) enabling the roof (208) of the second member (207) to compress, puncture or crush the capsule (201), which is contained within the channel (202) of the first member (200) against the sharp ridge floor (204) of the perforated channel (202) of the first member (200). The crushing and puncturing action of the sliding second member 207 allows the colorant to leak from the capsule (201) and be dispersed through the first holes (203) in the floor of the channel (202) of the first member (200) into the clear beverage below.

The third member (210), which is a slidable sport cap, can then be lifted upward upon the spout (209) of the second member (207), allowing consumption of a newly colored beverage by way of a flow-through channel provided by second holes 206 in the perforated hub (205) of the first member (200), and by the spout (209) via perforations or holes (209*a*) in the second member (207).

Figure 19:
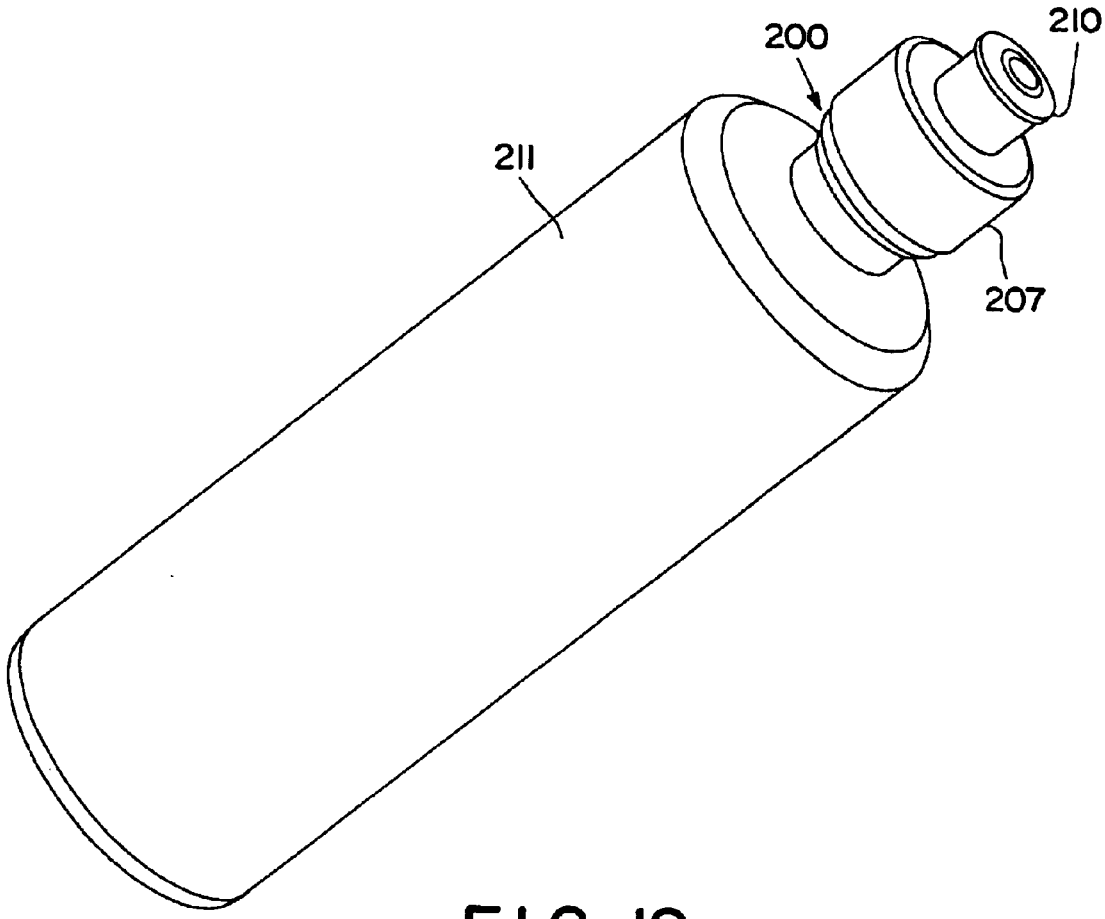
FIG. 19 is a perspective view of an assembled closure cap element in combination with a beverage container in accordance with a fifth embodiment of the invention.

Referring now specifically to FIG. 19, the first member 200 of the closure element 195 is shown screwed onto clear, see-through drinking bottle (211). In FIG. 19, the cap has been activated for drinking, by sliding the outer component or second member (207) down upon the screw cap component or the first member (200). The first member (200) cannot be seen since the outer component or second member (207) of the closure device covers it. The third member (210) is a slidable sport cap, which upon lifting, allows a flow-through channel for consuming the beverage in the drinking bottle (211) once it is colored.

Figure 20:
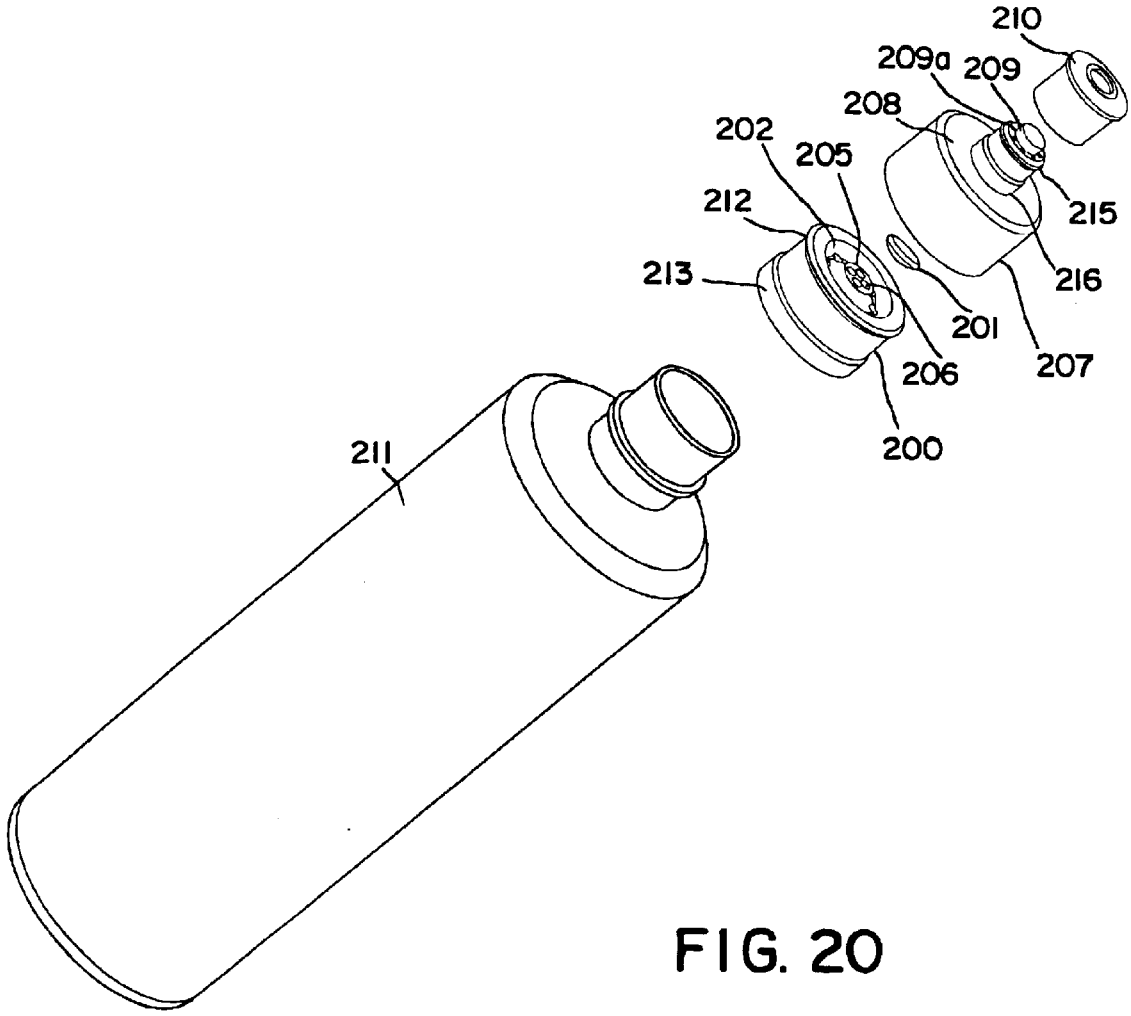
FIG. 20 is an exploded perspective view of the closure cap element and beverage container of FIG. 19.
Figure 21:
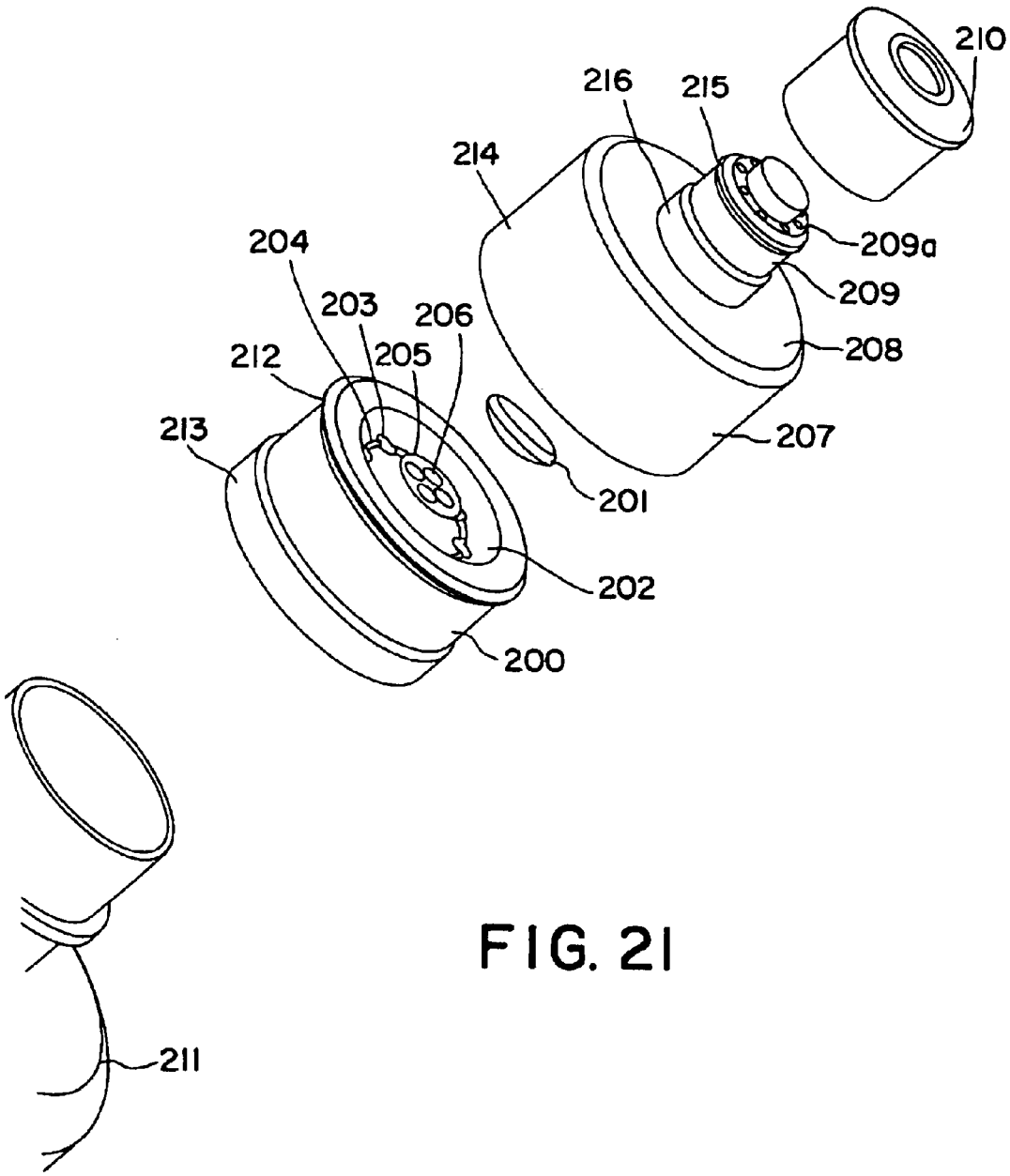
FIG. 21 is an enlarged exploded perspective view of the components shown in FIG. 20.
Figure 22:
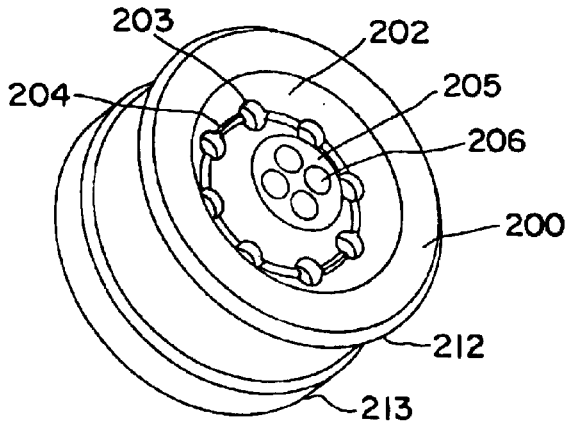
FIG. 22 is a perspective view of a first cylindrical member which is mounted on the beverage container of FIGS. 20–21.

In FIGS. 20 and 21, the closure elements are shown separated or disassembled from one another. In FIGS. 20, 21 and 22, the first member (200) is a modified screw cap containing a chamber defining the channel (202) which has the first holes (203) and a sharp ridge (204) on the floor thereof. The first holes (203) allow colorant to spill into the clear beverage within the drinking bottle (211) when the sharp ridge (204) on the floor punctures the colorant capsule (201). The channel (202) is circumferential and can hold one or more colorant capsules (201), which fit within the channel. In preferred embodiment, the depth of the channel (202) is approximately one half the width of the colorant capsule 201 or capsules so that at least half of a capsule projects above the top of the first member (200) when it is inserted into the channel (202). The first member (200) also has the perforated hub (205) having the second holes (206) therein, which act as a flow-through when consuming the beverage in the drinking bottle (211). The first member (200) also has an upper outer wall (212) and a lower outer wall (213) with circumferential ribs for sealing with the first member (207). The upper rib (212) is contoured or angled with either an acute or blunt edge acting as a seal when the second member (207) is pressed down upon the first member (200). The lower outer wall ridge (213) is configured as a blunt protrusion and also acts a seal when the second member (207) slides down upon the first member (200).

Figure 23:
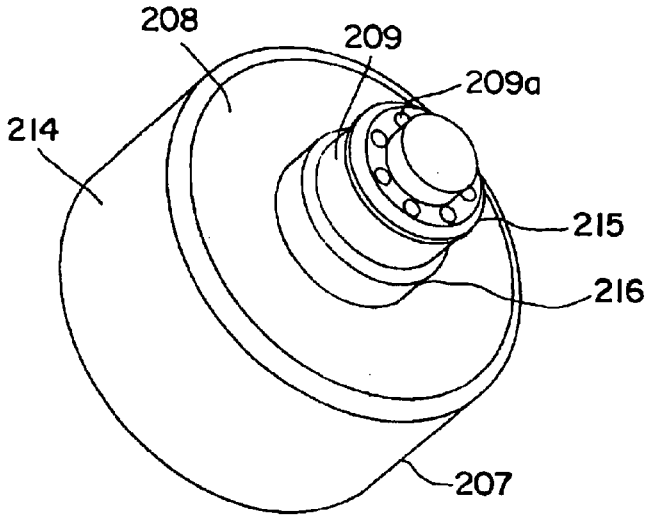
FIG. 23 is a perspective view of a second cylindrical member which is mounted on the first cylindrical member in FIG. 22.

FIGS. 20, 21 and 23 show the second member (207) or outer shell of the closure element (195) having a cylindrical wall (214) which is smooth inside, a roof (208), and a spout (209) which contains third holes (209*a*). Upper and lower outer annular ribs (215) and (216) on the walls of the spout (209) are provided to form sealing between the third member (210) and the spout (209) when the third member is pressed down into position on the spout (209). The third holes (209*a*) in the spout (209) provide a flow-through channel for consuming the colored beverage. The roof (208) of the second member (207) crushes or compresses the colorant capsule (201) within the channel (202) of the first member (200) when the second member (207) is pushed down upon the first member (200). The upper rib (212) and lower rib (213) on the first member (200) act as a seal to contain the beverage at all times, and especially when the second member (207) is pushed downward upon the first member (200).

The roof (208) of the second member (207) encloses the crushed colorant capsule (201) within the channel (202) of the first member (200) so that the capsule (201) cannot be consumed during consumption of the newly colored beverage. The capsule (201), which has been crushed by the sliding mechanism of the second member (207) upon the first member (200), allows the colorant to preferentially leak out into the newly enclosed channel (202) of the first member (200) by means the roof (208) of the second member (207), and flow through the first holes (203) in the floor of the channel (202) of member one (200) into the clear beverage in the drinking bottle (211). The only flow-through channel to consume the newly colored beverage is created by the second holes 206 in the perforated hub (205) on the first member (200) and the central perforated spout (209) on the second member (207).

Figure 24:
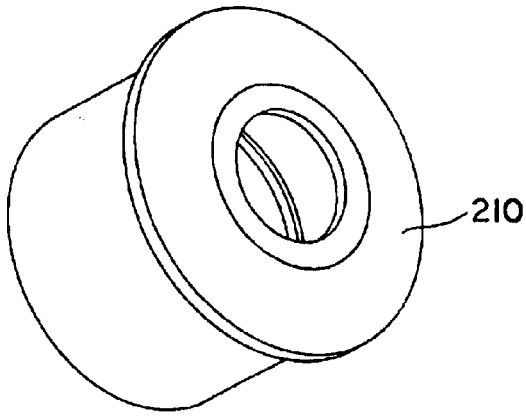
FIG. 24 is a perspective view of a sports cap closure which is mounted on the second cylindrical member of FIG. 23.

Regarding FIGS. 20, 21 and 24, the third member (210) is a sports cap element, which is assembled upon the spout (209) of the second member (207). The cap (210) has a smooth inner wall, which forms a seal with the upper and lower circumferential ribs on the spout (209) of the second member (207) when assembled thereon. Lifting or elevating this cap (210) allows the newly colored beverage to be consumed, whereas sliding the cap (210) downward, creates a seal upon the spout (209) of the second member (207).

The third member 210 therefore functions as an opener for allowing the beverage mixed with the colorant to flow through the second holes 206 and third holes 209*a* to the consumer.

Figure 25:
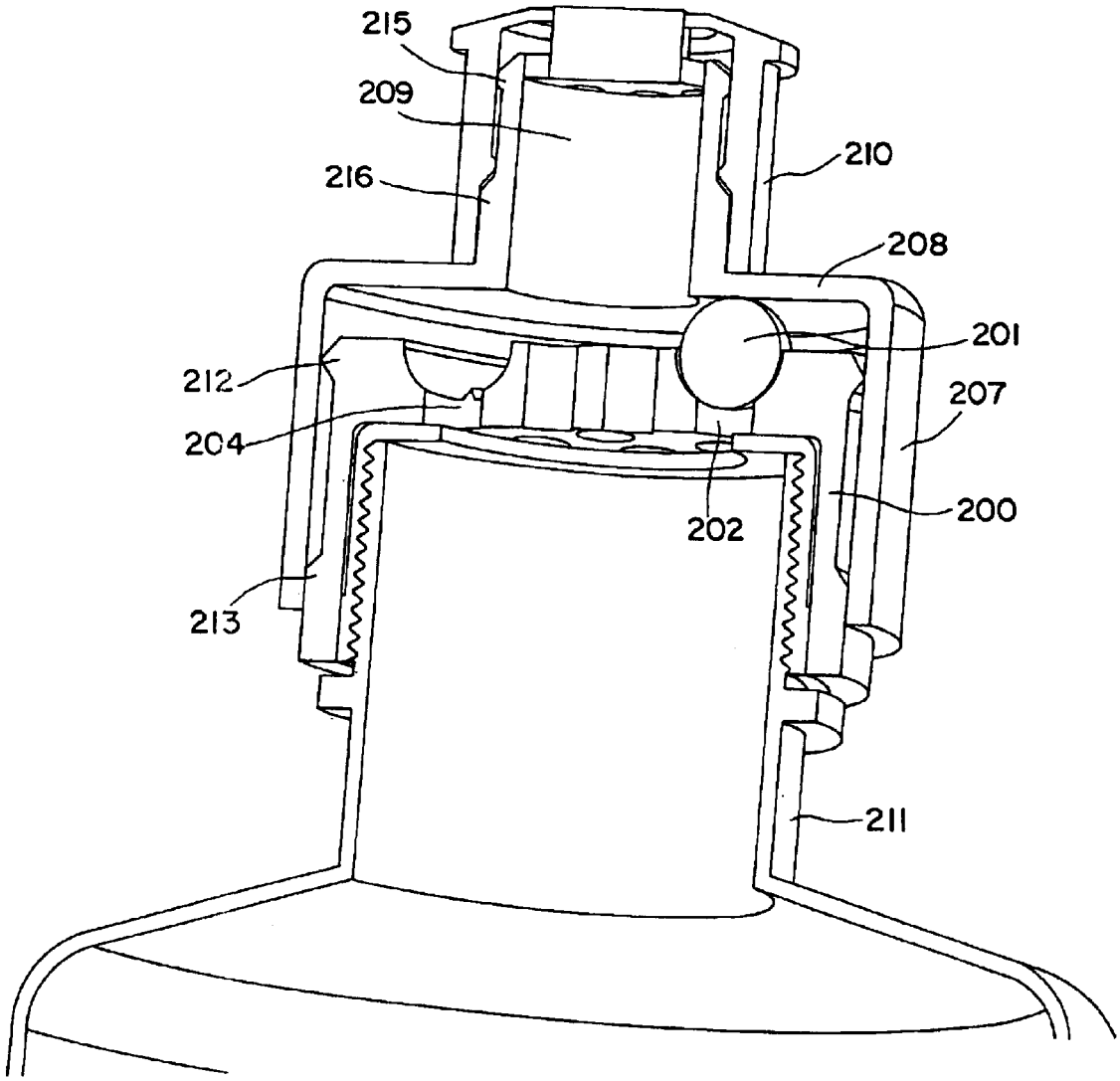
FIG. 25 is a perspective view, partially in elevation, showing an initial position of the first and second cylindrical portions prior to opening a liquid containing capsule disposed therebetween.

FIG. 25 shows the initial starting position of the second member 207 with respect to the first member 200 as packaged with the colorant capsule (201) positioned within the channel (202) of the first member. The roof (208) of the second member (207) is close to, and preferably slightly touching, the colorant capsule (201). This initial position prevents the capsule from moving or shifting position within the channel (202) of the first member (200).

Figure 26:
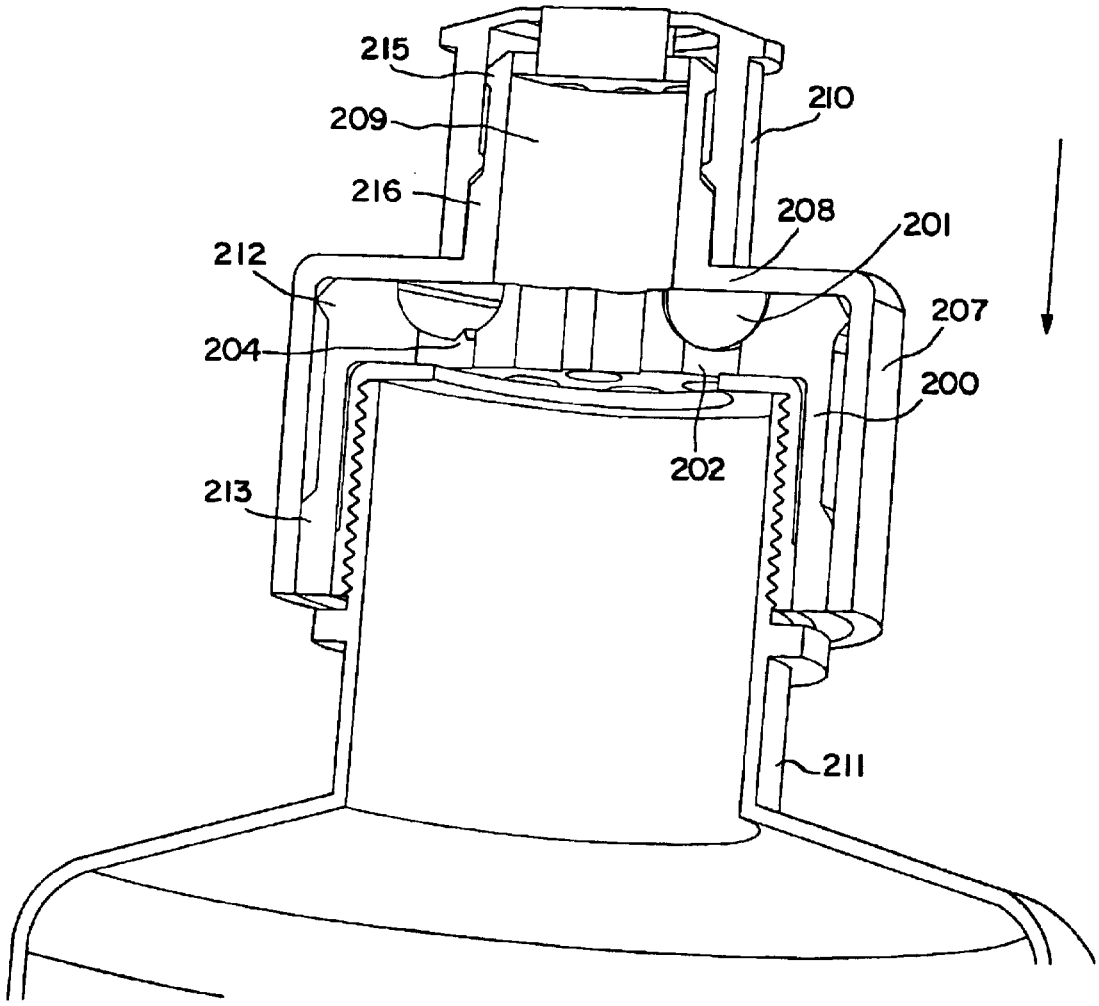
FIG. 26 is a view similar to FIG. 25 but showing the second cylinder advanced toward the first cylinder to open the liquid containing capsule.

In FIG. 26, the second member (200) is shown pressed down against a colorant capsule 201 to rupture or otherwise open the colorant capsule in order to release the colorant agent into the chamber provided by the annular channel (202), so that the colorant flows through the first holes (203) into the beverage within bottle (211).

The seals made by the upper (212) and lower ribs (213) on the first member (200) with the smooth outer wall of the second member (207), and the seal made between the upper (215) and lower ribs (216) of the spout (209) of the second member (207) with the third member (210), keep the released colorant and beverage contained within the closure element (195).

Figure 27:
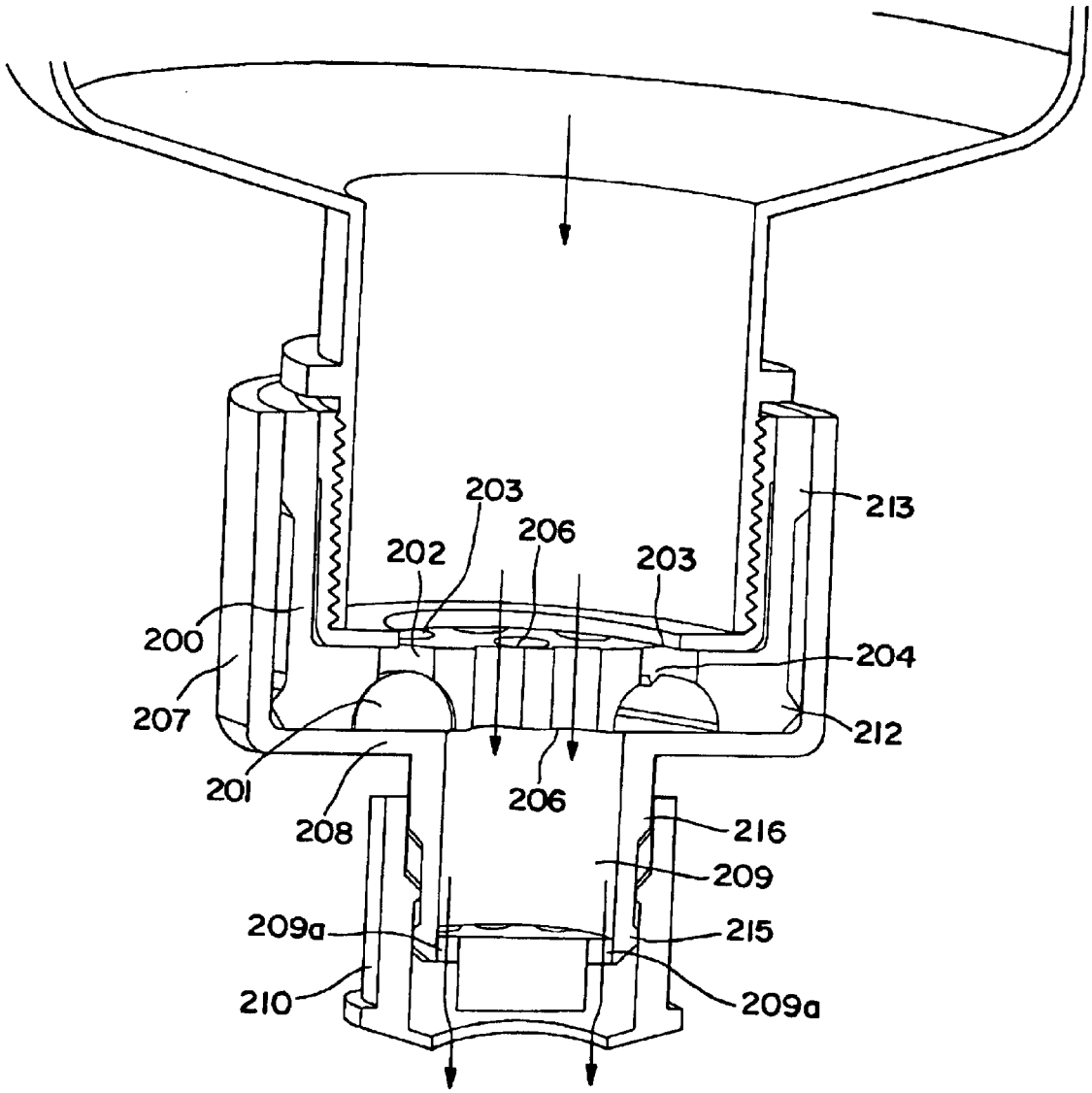
FIG. 27 is a view similar to claim 26 showing the sports cap of FIGS. 19–21 and 24 in an open position to permit consumption of the beverage in the container after the liquid contents of the capsule have been added to the beverage.
Figure 28:
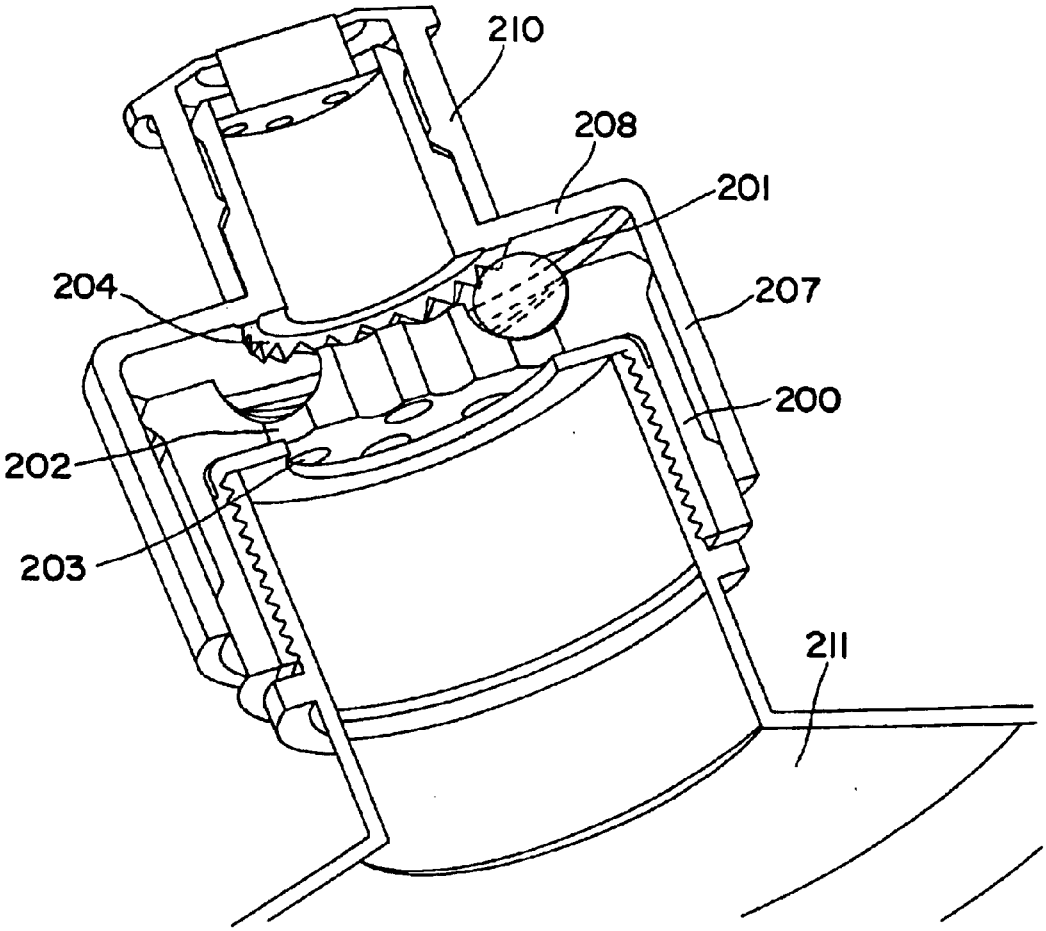
FIG. 28 is a perspective view of an alternative arrangement for opening the liquid containing capsule.

In FIGS. 25–27, the sharp ridge (204) is on the floor of the circumferential channel (202), whereas in FIG. 28 a sharp, jagged circumferential ridge (204) extends downward from the roof (208) of the second member (207) help crush and perforate the colorant capsule or capsules (201) held within the channel (202) of the first member (200). Once the colorant capsule(s) (201) is compromised, the colorant content leaks through the first holes (203) in the floor of the channel (202) of the first member (200), and into the clear beverage held within the see-through drinking bottle (211).

From the foregoing description, one skilled in the art can easily ascertain the essential characteristics of this invention, and without departing from the spirit and scope thereof, can make various changes and modifications of the invention to adapt it to various usages and conditions.

We claim:

1. A closure element for attachment to a dispensing opening of a beverage container, the closure element comprising:

a coupling for attaching the closure element to the dispensing opening of the beverage container;

a chamber within the closure element, the chamber initially containing a colorant agent and having a first portion and a second portion, at least the first poriton being in communication with a beverage through the dispensing opening of the beverage container for allowing the colorant agent to flow into the beverage, and at least the second portion being configured to dispense the beverage therethrough as the beverage passes through the chamber;

a first closer for closing the first portion of the closure element;

a second closer for closing the second portion of the closure element;

a first opener for opening at least the first closer to let the colorant flow therethrough into the beverage, and the second closer being openable for dispensing the beverage mixed with the colorant therethrough to the consumer.

2. The closure element of claim 1 wherein the closure element is a screw cap having threads which provide the coupling to the dispensing opening of the beverage container.

3. A closure element for attachment to a dispensing opening of a beverage container, the closure element comprising:

a coupling for attaching the closure element to the dispensing opening of the beverage container;

a chamber within the closure element, the chamber containing a colorant agent within at least one capsule and having a first portion and a second portion, the first portion being in communication with a beverage through the dispensing opening of the beverage container, and the second portion being configured to dispense the beverage therethrough as the beverage passes through the chamber;

a first closer for closing the first portion of the closure element;

a second closer for closing the second portion of the closure element;

an opener associated with the chamber for opening the capsule to let the colorant flow therefrom into the beverage, and the second closer being openable for dispensing the beverage mixed with the colorant therethrough to the consumer.

4. The closure element of claim 3 wherein the closure element is a screw cap having threads which provide the coupling to the dispensing opening of the beverage container.

5. The closure element of claim 3 wherein the closure element comprises a first cylindrical member on the beverage container and a second cylindrical member mounted on the first cylindrical member for movement with respect thereto, a first opening through the first cylindrical member to provide fluid communication between the chamber and the beverage within the beverage container, the chamber being disposed in one of the cylindrical members.

6. The closure element of claim 5 wherein the chamber is in the first cylindrical member.

7. The closure element of claim 5 wherein the chamber is an annular channel disposed in the first cylindrical member, the annular channel having the first openings therethrough.

8. The closure element of claim 7 wherein the annular channel is disposed around a perforated hub on the first cylindrical member, the perforated hub having second openings therethrough in communication with the beverage in the beverage container and in communication with a spout portion of the second cylindrical member, wherein colorant flows through the first openings to color the beverage, and wherein the beverage with the coloring agent therein passes through the second openings into the spout for consumption by the customer.

9. The closure element of claim 8 wherein a cap mounted on the spout closes and opens the spout.

10. The closure element of claim 9 wherein the cap is a sports cap which is slidable on a neck between a first position closing openings through the neck and a second position opening openings through the neck.

11. The closure element of claim 5 wherein the opener associated with the chamber for opening the capsule comprises edges on either the second cylindrical member or the first cylindrical member adjacent the holes therethrough for penetrating the at least one capsule to open the capsule and release the colorant to flow through the holes into the beverage.

12. The closure element of claim 3 wherein the first closer comprises at least one hole in the first portion of the closure element, which at least one hole is smaller than the at least one capsule to retain the capsule within the chamber and to thereby retain the colorant within the chamber until the capsule is opened.

13. The closure element of claim 3 wherein the second closer comprises at least one hole in the second portion of the closure element which is smaller than the at least one capsule to retain the capsule and colorant therein within the chamber on one side of the hole, the second closer being openable by an opener on the otherside of the hole to let the beverage which has been mixed with the colorant flow through the hole to the consumer.

14. The closure element of claim 3 wherein the first and second closers have holes smaller than the capsule for retaining the capsule and colorant within the chamber until the capsule is opened, the colorant flowing through the first closure into the beverage upon opening the capsule and thereafter flowing through the second closer while mixed with the beverage when the beverage container is tilted.

* * * * *